US009156049B2

(12) United States Patent
Galluzzo et al.

(10) Patent No.: US 9,156,049 B2
(45) Date of Patent: Oct. 13, 2015

(54) LIQUID PROJECTION APPARATUS

(75) Inventors: Paul Mark Galluzzo, Royston (GB); David Peter Henry Smith, Harlow (GB)

(73) Assignee: THE TECHNOLOGY PARTNERSHIP, PLC., Melbourn, Royston, Hertfordshire (GB)

( * ) Notice: Subject to any disclaimer, the term of this patent is extended or adjusted under 35 U.S.C. 154(b) by 115 days.

(21) Appl. No.: 13/637,171

(22) PCT Filed: Mar. 23, 2011

(86) PCT No.: PCT/GB2011/050578
§ 371 (c)(1),
(2), (4) Date: Mar. 1, 2013

(87) PCT Pub. No.: WO2011/117629
PCT Pub. Date: Sep. 29, 2011

(65) Prior Publication Data

US 2013/0200169 A1 Aug. 8, 2013

(30) Foreign Application Priority Data

Mar. 25, 2010 (GB) ..... 1004960.9

(51) Int. Cl.
*B41J 2/045* (2006.01)
*B05B 12/08* (2006.01)

(52) U.S. Cl.
CPC ..... *B05B 12/08* (2013.01); *B41J 2/04581* (2013.01); *B41J 2/04596* (2013.01); *B41J 2/04598* (2013.01); *B41J 2202/15* (2013.01)

(58) Field of Classification Search
CPC . B41J 2/04591; B41J 2/04588; B41J 2/04596
See application file for complete search history.

(56) References Cited

U.S. PATENT DOCUMENTS

| | | | | |
|---|---|---|---|---|
| 4,424,520 | A * | 1/1984 | Matsuda et al. | 347/11 |
| 5,329,293 | A | 7/1994 | Liker | |
| 5,543,827 | A | 8/1996 | VanSteenkiste et al. | |
| 5,907,337 | A * | 5/1999 | Tajika et al. | 347/40 |
| 6,196,656 | B1 | 3/2001 | Ghosh et al. | |
| 6,267,464 | B1 | 7/2001 | Furlani et al. | |
| 2009/0167815 | A1 * | 7/2009 | Ito | 347/32 |
| 2009/0213156 | A1 * | 8/2009 | Okada et al. | 347/13 |
| 2010/0039480 | A1 * | 2/2010 | Brown et al. | 347/68 |
| 2010/0141708 | A1 * | 6/2010 | Brown | 347/47 |
| 2010/0294793 | A1 * | 11/2010 | Brown et al. | 222/1 |
| 2012/0236055 | A1 * | 9/2012 | Wada et al. | 347/12 |

FOREIGN PATENT DOCUMENTS

| | | |
|---|---|---|
| EP | 1243417 | 9/2002 |
| WO | 9310910 | 6/1993 |
| WO | 9954140 | 10/1999 |
| WO | 2008044073 | 4/2008 |

* cited by examiner

*Primary Examiner* — Stephen Meier
*Assistant Examiner* — Renee I Wilson
(74) *Attorney, Agent, or Firm* — Tarolli, Sundheim, Covell & Tummino LLP

(57) ABSTRACT

A method of producing droplets from a nozzle provided on a material layer, the method comprising the steps of supplying liquid to an inner end of an array of nozzles, the nozzles being split into M groups of one or more nozzles, generating one or more firing signals, each firing signal causing sufficient movement of a group of nozzles relative to the liquid such that liquid is projected as droplets from the outer face of the respective nozzles, generating one or more sub-firing signals associated with each group of nozzles, the one or more sub-firing signals causing movement of the group of nozzles which is insufficient to project liquid from the nozzles, the sub-firing signals of adjacent groups having a non-zero phase relationship, wherein the sub-firing signal(s) of at least one group of nozzles is independent of the firing signal(s) associated with that group.

16 Claims, 17 Drawing Sheets

This is a group of 6 nozzles; the same pattern may be repeated with all other groups of 6 nozzles. In other words, a device with N nozzles can be sub-divided into groups with N' nozzles, where N could be (for example) 128, and N' could be 6. Alternatively N' and N could be the same.

Figure 1
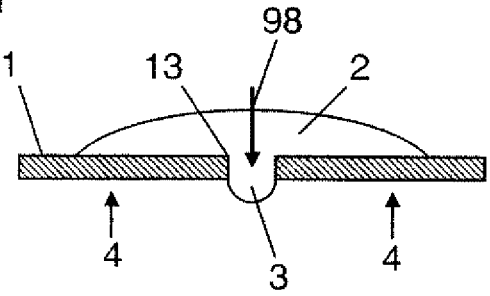
Figure 2
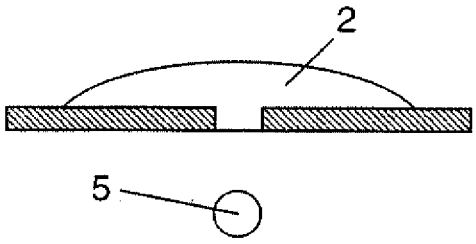
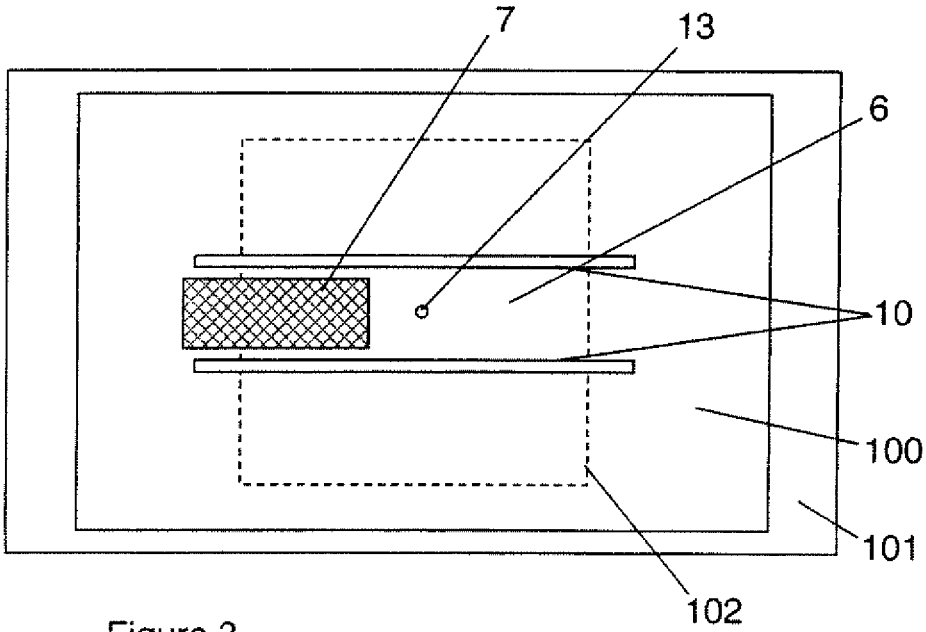
Figure 3

Figure 5a
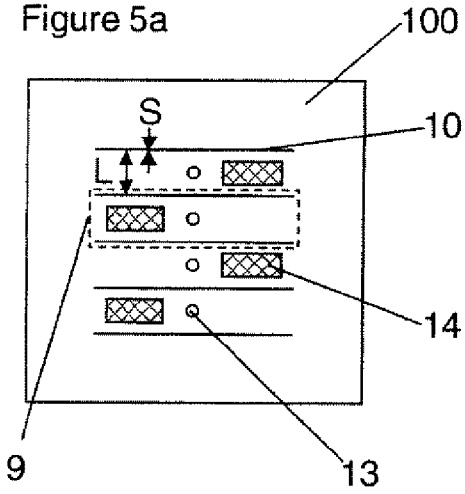
Figure 5b
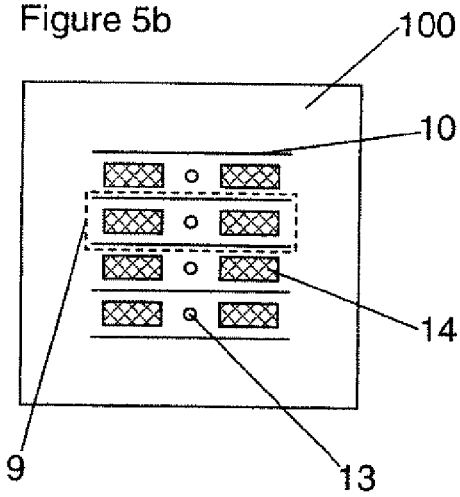
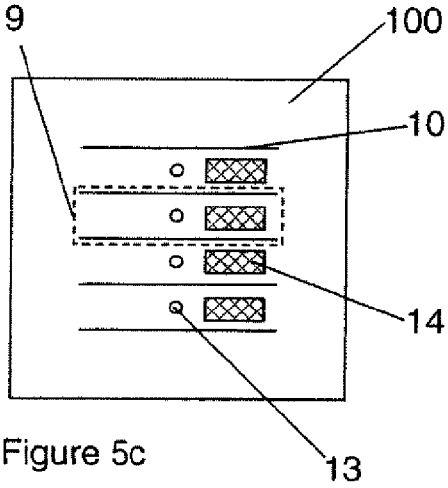
Figure 5c
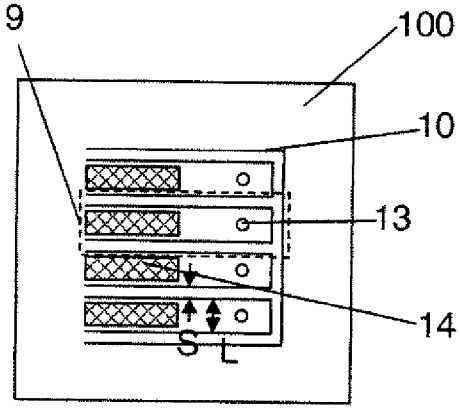
Figure 5d 44e
45e
44b
45b
44a
45a
45d
44d
45c
44c
400
Time
Amplitude of motion/signal 44e
46e
46b
44b
46a
44a
46d
44d
46c
44c
400
Time
Amplitude of motion/signal This is a group of 6 nozzles; the same pattern may be repeated with all other groups of 6 nozzles. In other words, a device with N nozzles can be sub-divided into groups with N' nozzles, where N could be (for example) 128, and N' could be 6. Alternatively N' and N could be the same.

LIQUID PROJECTION APPARATUS

FIELD OF THE INVENTION

The present invention relates to a liquid projection apparatus in the form of what is known as a 'face-shooter' array and a method of producing droplets therefrom.

BACKGROUND OF THE INVENTION

In our previous application WO 93/10910 we describe a device for projecting droplets from a nozzle that is excited to project liquid therefrom.

In our previous application WO99/54140 we describe a device and method for projecting liquid as jets or droplets from multiple nozzles formed in a material layer. The nozzles are formed in a transducer that incorporates a finger with liquid being supplied to an inner end of the nozzles. By continuously stimulating excitation of the finger motion at a certain frequency, the nozzle will eject a continuous droplet stream from an outer end of the nozzle.

In the type of device described in WO 93/10910 and WO 99/54140, there is no local chamber and hence no reflected pressure waves of the type found in many other known devices. The invention, as described later, is equally applicable to the devices in either of these documents and indeed to any open-reservoir structure with front-face actuators.

During printing or fluid dispensing from the type of devices described in WO99/54140 and WO 93/10910, debris, dried ink, solute or other unwanted materials ("crud") can form on the material layer, both on the outlet side and the inlet side. It is necessary to periodically clean and remove this debris and this is particularly important when printing biological material (e.g. for diagnostic purposes) or fluids that evaporate easily. With this type of medium, the nozzles through which the material is being ejected get crusty when not in use, even if that use is only for a relatively short period of time.

In U.S. Pat. No. 5,543,827, U.S. Pat. No. 6,267,464 and U.S. Pat. No. 6,196,656 devices are described that contain a number of dedicated piezoelectric actuators that can be operated to result in ultrasonic actuation of the material layer to loosen debris on the material layer. Although this can be an effective way of clearing the debris, the requirement of piezoelectric actuators solely for the use of cleaning increases the cost and complexity of such devices.

U.S. Pat. No. 5,329,293 describes a technique for clearing ink jet heads which uses sub-firing signals in between ejections which are ineffective in causing ejection, and where the sub-firing signals are synchronous with the firing signals, i.e. the sub-firing signal is at a predetermined time after the firing signal. This is applied in the context of standard ink jet heads where the actuators are situated within or so as to form enclosed chambers.

The use of sub-firing signals on their own enable the fluid meniscus to re-suspend or re-dissolve the crud deposited on the outer face of the nozzle as a result of solvent evaporation (or carrier evaporation if it's a suspension), as the meniscus is caused to move back and forth. However, even with such an approach, there is a concentration of the crud in the bulk fluid near the inner face of the nozzle.

SUMMARY OF THE INVENTION

According to the present invention, there is provided a method of producing droplets from a nozzle provided on a material layer, the method comprising the steps of:

supplying liquid to an inner end of an array of nozzles, the nozzles being split into M groups of one or more nozzles;

generating one or more firing signals, each firing signal causing sufficient movement of a group of nozzles relative to the liquid such that liquid is projected as droplets from the outer face of the respective nozzles; and generating one or more sub-firing signals associated with each group of nozzles, the one or more sub-firing signals causing movement of the group of nozzles which is insufficient to project liquid from the nozzles, the sub-firing signals of adjacent groups having a non-zero phase relationship, wherein the sub-firing signal(s) of at least one group of nozzles is independent of the firing signal(s) associated with that group.

In this context we specifically want to employ an asynchronous sub-firing regime, which preferably creates a ripple (Mexican wave) effect across the ejecting face of the head. By "asynchronous", we mean that not all the nozzles are fired at the same time and, in particular, that the sub-firing signals are on adjacent nozzles or groups of nozzles are out of phase, but also that the individual sub-firing signal is not tied directly to the firing signal on a particular nozzle or groups of nozzles, but rather is controlled by some other factor. This provides the benefit of acoustic streaming in the region where the ink meets the actuating nozzles and this results in the clearing of debris or other build-up from the inner face of the nozzles.

The method of the present invention is beneficial for devices in which the nozzles are not contained within associated individual chambers and between which fluid can flow.

By the present invention, liquid which has concentrated on the inner end of the nozzles is transported back into the bulk liquid, mixing it and redistributing, to further reduce the amount of solid particles being deposited near the nozzles.

In a preferred embodiment, M is an integer greater than zero. The amplitude of the sub-firing signals is preferably lower than the amplitude of the firing signals. The duration of the sub-firing signals is preferably shorter than that of the firing signals. The frequency of the sub-firing signals is preferably different to that of the firing signals.

The sub-firing signals associated with a group of nozzles preferably produces an oscillatory motion in the nozzles in that group. Such oscillatory motion is typically approximately or exactly sinusoidal.

The phase difference between adjacent groups is preferably $2\pi(yM+1)/M$, where y is a non-negative integer.

The sub-firing and or firing signals may be single or multiple pulses and, indeed, the sub-firing and firing signals can have different numbers of pulses.

The number of nozzles in each group may be the same or, if the operation requires it, the number of nozzles may be different between groups.

The sub-firing signals may be driven by a separate clock to that which drives the firing signals.

The sub-firing signals may occur on a particular nozzle or group of nozzles prior to the first firing signal on that nozzle or group of nozzles.

The sub-firing signal on a particular nozzle or group of nozzles may be dependent upon the firing signal from a different nozzle or group of nozzles. The firing signals may include both firing stop impulses.

The present invention further comprises an apparatus for producing droplets, the apparatus comprising:

an array of nozzles, the nozzles being split into M groups of one or more nozzles;

means for supplying liquid to an inner end of the array of nozzles;

control means for generating one or more firing signals, each firing signal causing sufficient movement of a group of nozzles relative to the liquid such that liquid is projected as droplets from the outer face of the respective nozzles; and control means for generating one or more sub-firing signals associated with each group of nozzles, the one or more sub-firing signals causing movement of the group of nozzles which is insufficient to project liquid from the nozzles, the sub-firing signals of adjacent groups having a non-zero phase relationship, wherein the sub-firing signal(s) of at least one group of nozzles is independent of the firing signal(s) associated with that group.

In one arrangement, such transport of liquid is achieved by acoustic streaming, whereby an oscillatory acoustic motion of the nozzles sets up a steady fluid motion. For example acoustic streaming is often achieved in conjunction with Surface Acoustic Waves. With a head as per WO99/54140, or indeed a multi-channel head using a plurality of device as per WO 93/10910, or in general any droplet ejector with a shared reservoir and open geometry, this can simply be accomplished by driving the nozzles in a ripple pattern, i.e. adjacent nozzles or groups of nozzles have their respective sub-firing signals out of phase. In a preferred arrangement, the nozzles or groups of nozzles are driven such that a ripple or "Mexican wave" pattern is created across the array of nozzles, e.g. where adjacent nozzles are out of phase by a fixed phase—like a phased array.

Each nozzle, or group of nozzles, can be driven so as to create sinusoidal, or at least approximately sinusoidal, motion typically of limited duration.

The drive signal, firing or sub-firing which would in most instances be a sub-firing signal, could be similar to the Drop-on-Demand drive signal, where the timing of the sub-firing signal is staggered by a fixed amount from nozzle to nozzle.

In the specific examples described below, any mention of ink or other specific material being ejected from the nozzle(s) is taken to be understood only to be an example and not limiting to that particular material. The invention can produce droplets of any liquid, typically a suspension or solvent based liquid.

BRIEF DESCRIPTION OF THE DRAWINGS

Examples of the invention will now be described with reference to the accompanying drawings, in which:

FIG. 1 illustrates a cross-section of a device illustrating, in simplified form, the principle of operation whilst the material layer applies an impulse to the fluid;

FIG. 2 illustrates a cross-section of a device illustrating, in simplified form, the principle of operation after the material layer has applied an impulse to the fluid;

FIG. 3 illustrates a plan view of a first device;

FIG. 5*a, b, c, d* illustrate plan views of four further examples;

DETAILED DESCRIPTION OF THE INVENTION

Figure 4:
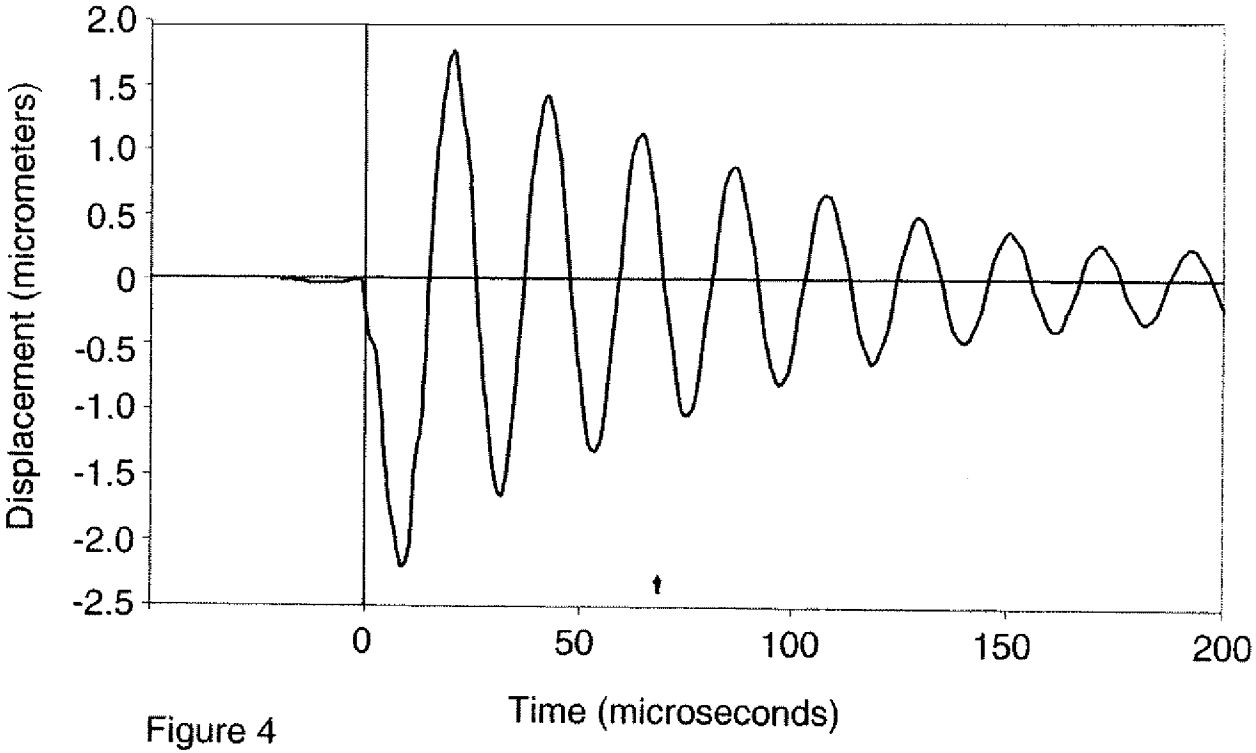
FIG. 4 shows experimental data of the motion of a device following a 10 microsecond pulse applied at time=0.

FIG. 1 shows a nozzle-bearing plate 1 formed in a material layer, containing a nozzle 13. An impulse applied to the fluid by the material layer shown at 4 induces positive pressure excursions in liquid 2 resulting in emergent liquid 3 through nozzle 13 in a direction shown at 98. FIG. 2 shows an emergent droplet 5 caused by the effects shown in FIG. 1. This, together with the ability of devices to provide pressure excursions of time duration in the region of one micro-second to one milli-second, advantageously allows liquid projection at very high frequencies.

One example embodiment, which has been reduced to practice, of a single transducer of the overall array device, is shown in plan view in FIG. 3. This illustrates a transducer incorporating a 'beam' or 'finger' 6, with, for example, one piezoelectric element 7 formed of PZT per nozzle 13. Nozzle 13 penetrates through material layer 100. This construction can provide a nozzle 13 mounted at the motional anti-node of the transducer, giving a symmetric pressure distribution in the sub-region of the nozzle. The transducer is distinctly formed, in this case, by the introduction of slots 10 into material layer 100, and by mounting the piezoelectric element 7 and material layer 100 assembly on a substrate 101 with a hole 102.

In this example as an operating liquid projection device, material layer 100 is electroformed Nickel of 60 microns thickness and bearing a nozzle of exit diameter 20 microns. The slots 10 were formed by electroforming and are of width 40 microns; the slot length is 6 mm, and the distance between the centres of adjacent slots 10 is 254 microns. The piezoelectric components 7 have width 214 microns, and are formed of piezoelectric ceramic 5H sourced from CTS providing high piezoelectric constants and mechanical strength. The electrode material applied to said piezoelectric components 7 was sputtered Nickel gold of thickness in the range 2-5 microns. In this example the piezoelectric material was mounted between the material layer 100 and the substrate 101. The material layer 100 was bonded to the piezoelectric material 7 and the piezoelectric material 7 was bonded to the substrate 101 using Epotek 353 supplied by Promatech. Electrical connections were made to the piezoelectric material 7 via the material layer 100 and the substrate 101.

By stimulating excitation with only one or a discrete number of such cycles the device ejects droplets 'on demand' i.e. responsive to that short droplet-projection pulse or pulse train, and ceasing after that pulse train ceases. The device described above was operated with a drive voltage of 100V peak to peak and with a base frequency of 46.6 kHz. With other devices of this general form, on-demand ejection has been observed with a drive voltage of 40V peak-to-peak. The electrical signals required to drive the device can be derived from a number of means such as an array of discrete device drivers or from an ASIC.

This liquid projection apparatus whose fabrication was described above was mounted onto a manifold to provide liquid supply means and in proximity to printing media to form a system suitable for ink-jet printing. Using water-based ink, at a supply bias pressure from 0 to 30 mbar below atmospheric pressure, the device was demonstrated operating in drop on demand mode. It was found experimentally that no sealant was needed in order to prevent egress of fluid from the slots.

The experimental measurement of the motion of the device of FIG. 3 following a 10 microsecond pulse is shown in FIG. 4. The motion is dominated by one mode with a characteristic frequency of 46.6 kHz.

In alternative constructions for the example of FIG. 3, unimorph (single layer) and bimorph (double layer) or multilayer geometries may be employed for the excitation means shown at 7. The thickness of the region of material layer material 100 near the ends of the slots, and the dimensions of the excitation means material 7 are chosen to control the resonant frequency of the device.

Being substantially isolated by slots 10 and by the substrate 101, arrays of such transducers allow substantially independent control of drop ejection from an array liquid projection device such as an ink-jet printhead/dispenser.

FIGS. 5*a*, 5*b*, 5*c* and 5*d* illustrate optional constructions wherein multiple nozzle-bearing transducers 9 are formed within the material layer 100, their lateral extent being defined by the slots 10. Each such transducer bears a nozzle 13 through layer 100. FIGS. 5*a*, 5*b*, 5*c* and 5*d* differ in that they illustrate a variety of permutations of excitation means configuration 14, as shown.

The "characteristic dimension of the material layer" is defined as the smallest dimension of a region of the material layer, which is normal to the direction of nozzle motion, which is moving substantially in phase.

In an example of the device type such as those illustrated in FIG. 5, the characteristic dimension of the material layer is the width of the moving portion of the material layer 100, 214 μm. The dimensions of the common region behind the material layer 100 is 25 mm depth of fluid behind the material layer 100, 2.8 mm in a direction in the plane of the material 100 and substantially parallel to the slots 10, and 36.6 mm in a direction in the plane of the material layer 100 and substantially perpendicular to the slots 10. This device enables the ejection of fluids with a wide range of rheological properties.

Figure 6:
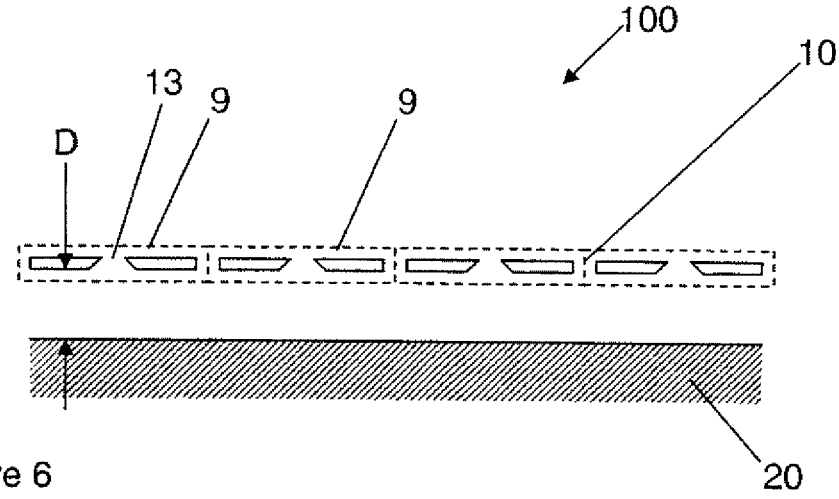
FIG. 6 is a cross-section of the device, illustrating a rigid surface provided at the rear of the transducers.

A rigid surface 20 may be provided substantially parallel to the moving material layer 100 and at a distance D behind the inner face of the moving material layer as shown in FIG. 6. For a given motion of the material layer the impulse applied by the material layer to the fluid is increased by the presence of a rigid surface 20.

As noted above, pressure is generated in the fluid through the impulse of the moving material layer. By increasing the impulse applied to the fluid, for a given motion of the material layer, the rate of fluid flow through the nozzle 13 is increased. Therefore, increasing the impulse applied to the fluid by the material layer for a given motion of the material layer reduces the motion of the material layer that is required in order to eject liquid droplets.

In order to increase the impulse applied to the fluid by the material layer, the distance D should be comparable to or smaller than the characteristic dimension of the material layer, L.

Without the rigid surface 20, or with a rigid surface 20 at a distance D from the material layer where D>>L, for example D ten times greater than L, the pressure behind the material layer is proportional to the characteristic dimension L of the material layer. When a rigid surface 20 is placed at a distance D from the material layer where D is much less than L, for example D equal to half L or less, then the pressure generated by motion of the material layer is proportional to $L^2/D$. At intermediate distances the pressure generated by the same motion of the material layer will vary with L in a manner between L and $L^2/D$.

Figure 7A:
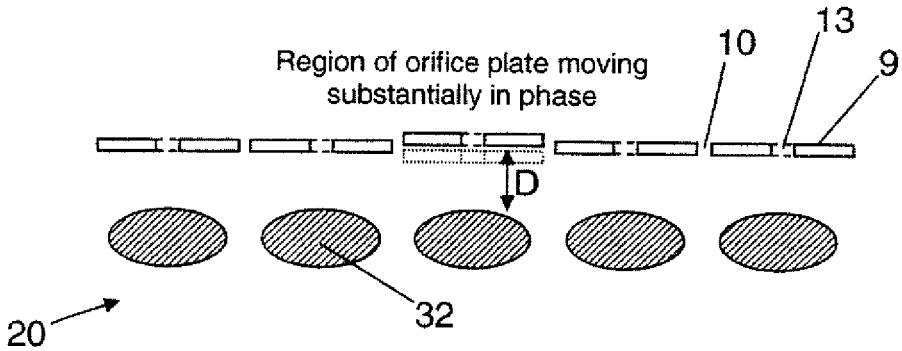
FIG. 7*a* is a cross-section of the device, illustrating a patterned surface provided at the rear of the transducers.

In a second example, the rigid surface 20 is patterned as shown in FIG. 7*a*. This allows the impulse applied to the fluid by the material layer to be increased behind each nozzle for a given motion of the material layer, thereby reducing the motion of the material layer required for ejection. In addition, this example is advantageous because the gaps in the rigid backplane reduce fluidic crosstalk between the nozzles 13.

Crosstalk can be defined as being the amount that an ejection event is changed (typically a change in the velocity or volume of an ejected drop) by the presence of an ejection event from a neighbouring nozzle. Consider two adjacent independently actuated regions of material layer each with a nozzle 13, material layer region A and material layer region B. If material layer region B is driven in isolation with fixed drive conditions, pressure is generated behind material layer region B to cause ejection. If both material layer regions A and B are simultaneously driven to cause ejection, then the pressure under both material layer regions A and B will be changed slightly by the motion of the adjacent material layer region compared to that when they are driven in isolation. This small pressure change behind each material layer region results in a change in the drop volume and/or drop velocity of the drop ejected by each material layer region compared to that when it is driven alone. This change is the crosstalk between material layer region A and material layer region B. The crosstalk will thus be reduced if the ratio of the pressure generated behind material layer region B due to the motion of material layer region B to the additional pressure generated behind material layer region B due to the motion of material layer region A is increased. Placing a rigid surface behind each material layer region A and B increases the pressure behind material layer region B due to the motion of material layer region B. The pressure behind region B is increased by a larger ratio than the increase in the additional pressure behind material layer region B that results from the motion of material layer region A. This is a result of the additional pressure generated being dissipated in the gaps between the rigid surfaces. Thus placing a rigid surface behind each material layer region reduces the fluidic crosstalk.

Figure 7B:
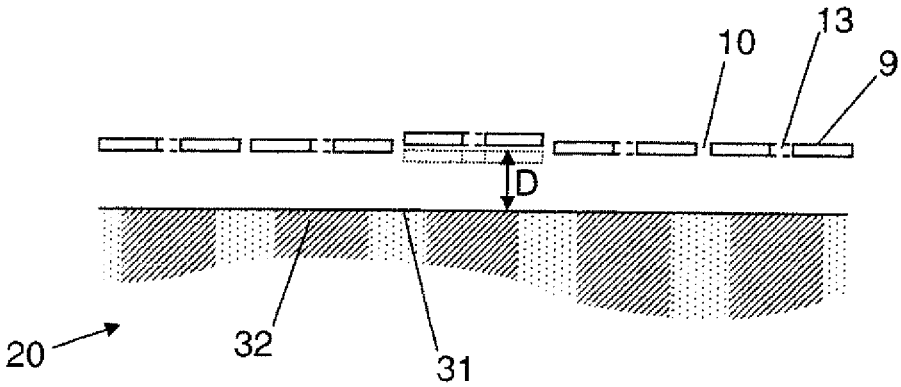
FIG. 7*b* is a cross-section of the device, illustrating a surface with rigid and compliant surfaces provided at the rear of the transducers.
Figure 8A:
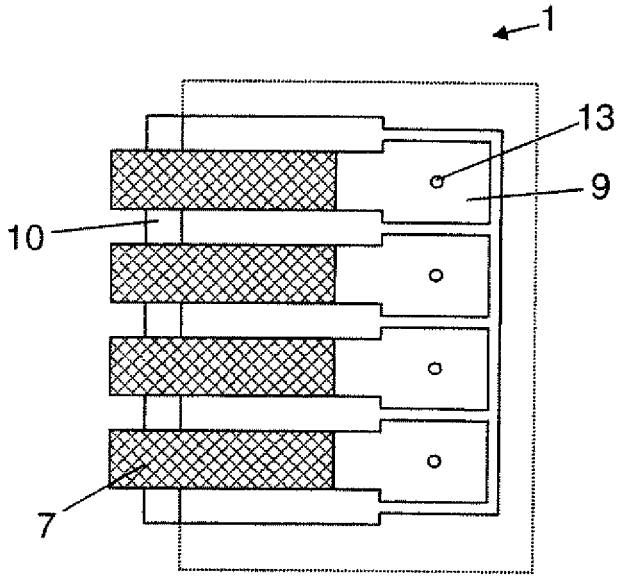
FIGS. 8*a-d* illustrate examples in plan view, of variation in slot width between transducers.
Figure 8B:
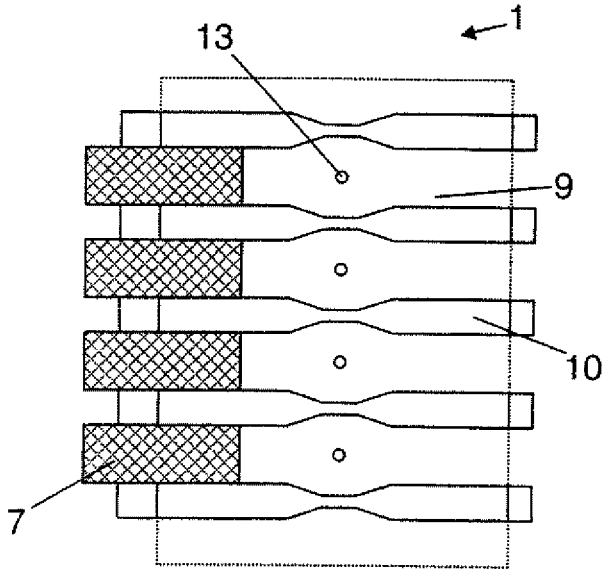
Figure 8C:
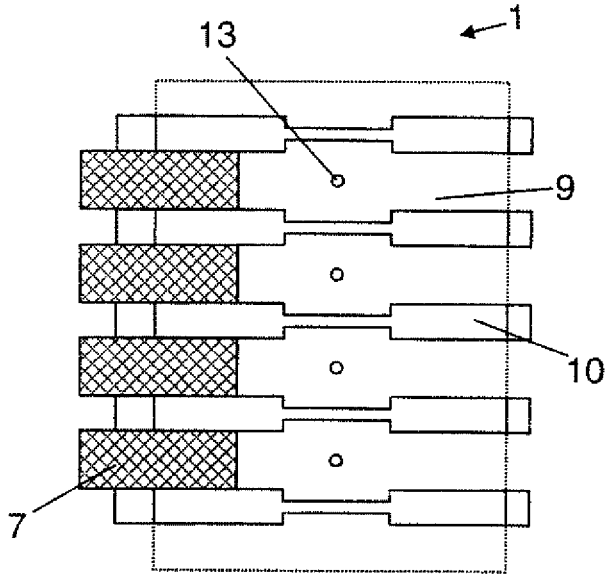
Figure 8D:
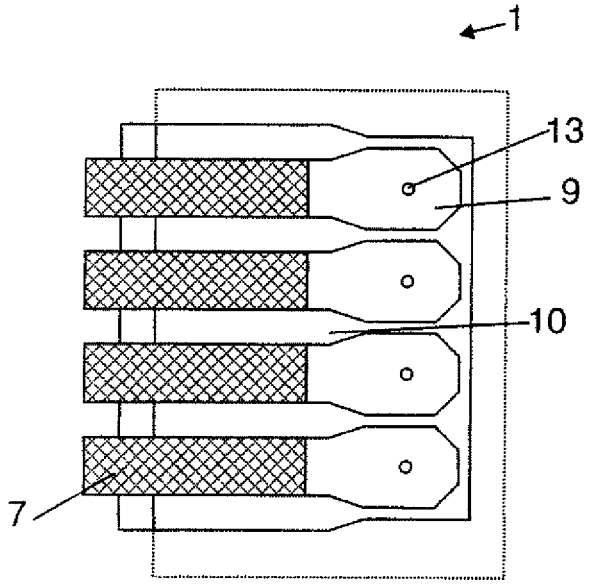

In a third example shown in FIG. 7*b*, compliant surfaces 31 are provided between the sections 32 of patterned rigid surface 20. The patterned sections of rigid surface 20 act to increase the pressure behind a nozzle 13, thereby reducing the motion of the transducer 9 required for ejection, and the compliant surfaces 31 act to reduce crosstalk.

The width of the slot 10 between adjacent transducers 9 can be varied along the length of the transducer as shown in FIGS. 8*a-d*. In the particular examples shown in FIG. 8*a-d*, the width of the slot 10 between two adjacent transducers 9 is greater at a distance away from the nozzle 13 than the width of the slot adjacent the nozzle.

By increasing the slot width in some regions along the length of the slot 10, spatial crosstalk is reduced between the transducers. It is desirable to reduce crosstalk so that the motion of one nozzle-bearing transducer 9, when excited to eject liquid from its associated nozzle 13, does not cause substantial pressure fluctuations in liquid that is adjacent to nozzle-bearing regions of other transducers. The definition of crosstalk is discussed in relation to FIG. 7.

The pressure that is transmitted, by a moving material layer region to the fluid behind a neighbouring material layer region, is reduced by the action of the air liquid interface in the slot, which acts as a pressure absorbing surface. By increasing the width of the slot 10 between two neighbouring material layer regions, the amount of pressure absorbed by the air liquid interface is increased. The pressure absorbing surface could also be a surface that has a low bending stiffness and low inertia and is therefore able to respond during the time scale with which the pressure in the fluid is created and removed, thus absorbing some of the pressure. For instance, the slot could be covered with a compliant membrane.

Figure 9:
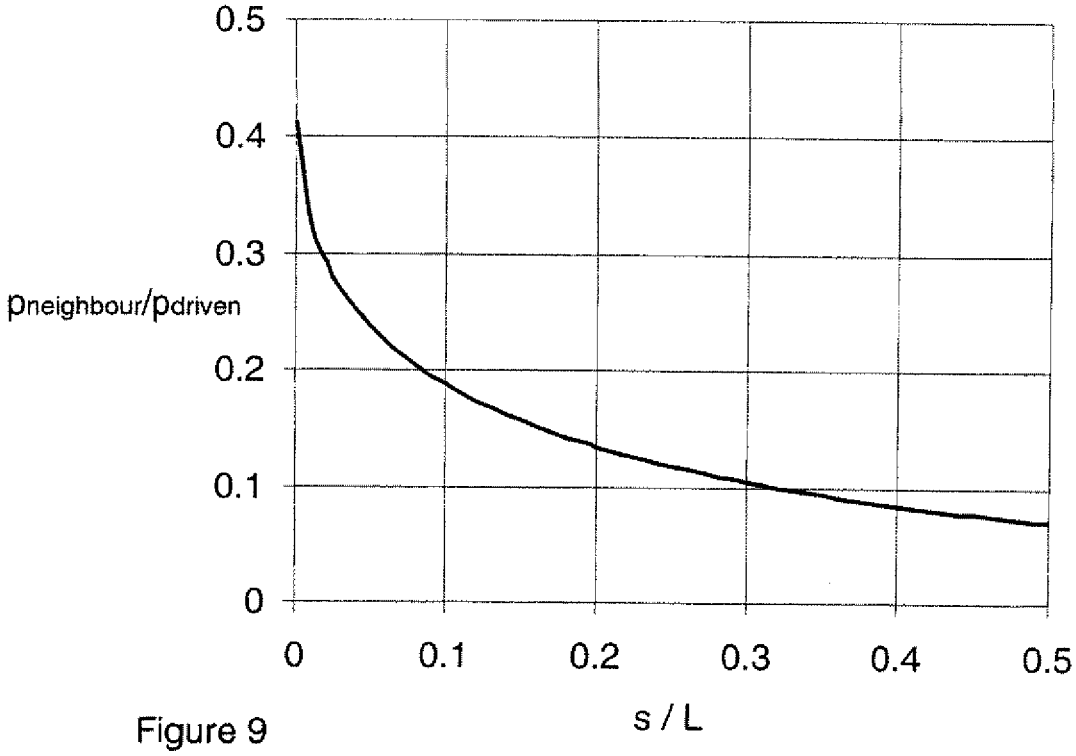
FIG. 9 illustrates the effect of altering the slot width between transducers.

In the examples shown in FIGS. 5*a-d* where the width of the moving material layer region is much smaller than the length of the transducer, the pressure under a material layer region, which neighbours a driven moving material layer region, depends on the width of the finger (L) and the width of the slot(s) as shown in FIG. 9. Spatial crosstalk is minimised when the ratio of the pressure at the neighbouring nozzle to the pressure at the driven nozzle is as low as possible ($P_{neighbour}/P_{nozzle}$). As can be seen in FIG. 9, it is therefore desirable that the ratio of s/L is a large as possible.

It is not so advantageous simply to increase the width of the slot along the whole length of the transducer as this will also narrow the finger width. A narrow finger means that the motion required for ejection is increased. Therefore, the slots are widened at a distance away from the nozzle as illustrated in FIG. 8*a-d* in order to reduce the nearest neighbour crosstalk and significantly reduce the next nearest neighbour crosstalk while not significantly increasing the motion required for ejection.

Figure 10:
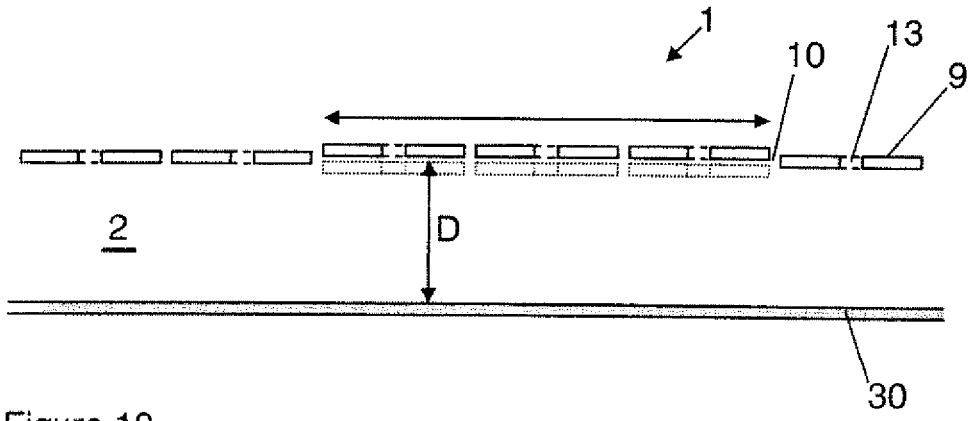
FIG. 10 is a cross-section of the device, illustrating a compliant surface provided at the rear of the transducers.

As illustrated in FIG. 10, a compliant surface 30, substantially parallel to the nozzle-bearing plate 1, can be provided at a distance D from the transducers 9. This surface will reduce both the pressure induced in the fluid 2 behind the transducers and the region over which that pressure is significant, if the distance D is comparable to or less than the minimum dimension of the area of material layer that is moving substantially in phase. The area of the material layer that is moving substantially in phase is illustrated by a horizontal arrow in FIG. 10. In this Figure, three transducers are moving substantially in phase.

The amount of pressure that is transmitted through the fluid behind the transducers 9 is reduced because the compliant surface 30 acts as a pressure absorbing surface.

A compliant surface is defined as a surface that will move in response to the pressure induced in the fluid on a timescale sufficiently short that it significantly reduces the pressure in the fluid next to the compliant surface compared to the pressure at that point when the compliant surface is replaced with a bulk region of fluid. The compliant surface 30 could be a compliant membrane, with air behind it, or it could be a soft foam, or it could be a liquid air interface.

Figure 11A:
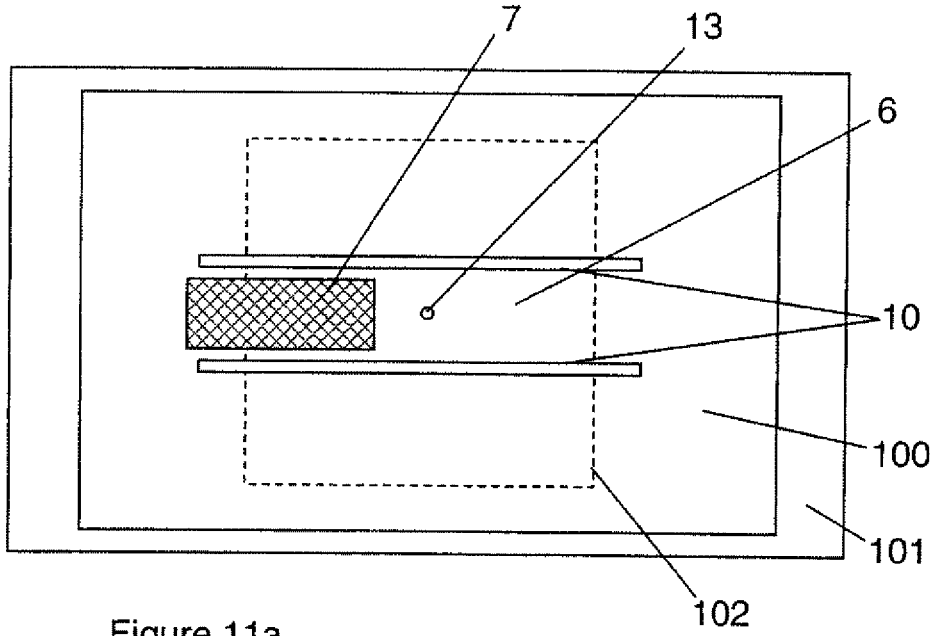
FIG. 11*a* is a plan view of the device, illustrating a compliant surface provided at the rear of the transducers.
Figure 11B:
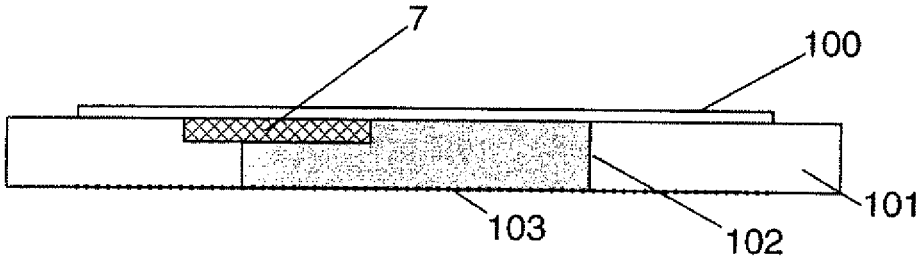
FIG. 11*b* is a cross-section view of FIG. 11*a;*

One example of a compliant surface as part of an ejecting device is shown in FIGS. 11*a* and 11*b*. This illustrates a compliant surface composed of an interface between air and fluid. The interface is supported by a fine mesh 103 (for example a steel mesh) that is placed behind the array of fingers 6.

In this example the device is similar in construction to that shown in FIG. 2 except that it also includes a mesh 103 that is clamped onto the back of the substrate 101. The fluid is fed into the hole in substrate 101 between the material layer 100 and the mesh. In this example, the distance between the mesh 103 and the material layer 100 is 400 micrometers.

In a further example shown in FIG. 7*b*, patterned compliant surfaces 31 are provided behind the nozzle-bearing plate 1. Between the compliant surfaces 31, behind the centres of the regions of the transducers 9 that can be independently moved, are provided rigid surfaces 32. The rigid surfaces 32 act to increase the pressure behind a nozzle 13, thereby reducing the amplitude of the transducer 9 required for ejection, and the compliant surfaces 31 act to reduce crosstalk.

The frequency at which drop on demand ejection can be made from a device is limited by the time it takes for the motion of the ejection system to decay to a level where it does not significantly affect the next ejection. If a device is made so that its motion is primarily mono-modal following a single voltage change, the motion can be built up and then cancelled by applying voltage changes at suitable times. Thus a lower voltage can be used to achieve a desired amplitude of motion and this motion can be stopped allowing the drop on demand frequency to be increased. If the device is not mono-modal and so energy is transferred into other modes then, in general, it is not possible to construct a signal that will successfully cancel the motion of the device in a small number of cycles of the dominant mode.

The device can be described as mono-modal when, following a single voltage change, the maximum velocity of the material layer due to the first order mode is significantly larger than the maximum velocity of the material layer due to higher order modes. Preferably the initial velocity of the device due to the first order mode is more than twice the velocity due to higher order modes. More preferably it is greater than four times the velocity due to higher order modes. This can be achieved by selecting a suitable ratio between the length of the piezoelectric actuator and the transducer length.

Figure 12:
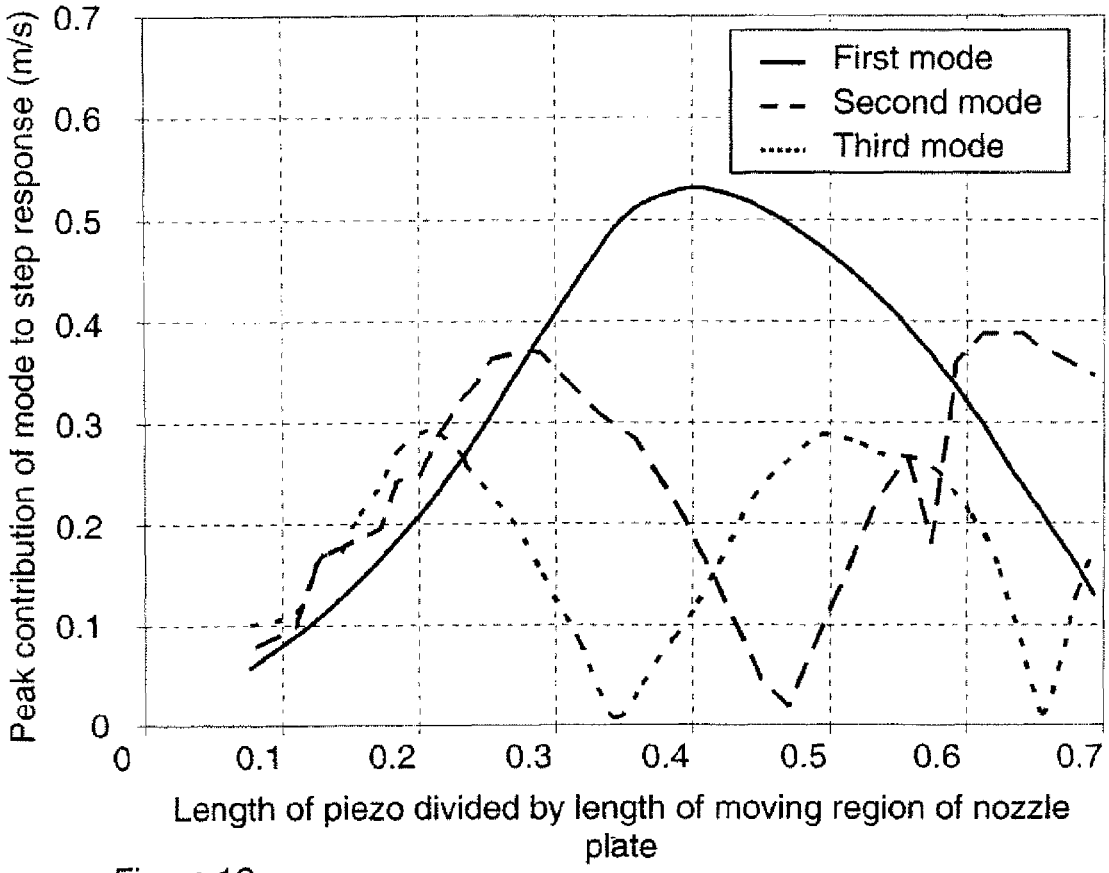
FIG. 12 shows the maximum velocity of the material layer due to the different resonant modes as a function of the length of the piezoelectric actuator.

For example consider the device shown in FIG. 2 with a 60 micron thick electroformed material layer and 100 microns thick bulk cut piezoelectric actuator. FIG. 12 shows the maximum velocity of the material layer due to each of the first, second, and third order modes as a function of the fractional length of the piezoelectric actuator as a proportion of the length of moving material layer, following a single voltage change for devices with resonant frequency of 50 kHz. This shows clearly that the ratio between the velocity from the first order mode and the velocity from the higher order modes is a maximum at around a piezoelectric actuator length fraction of 0.4. For the particular materials used, this length of the moving piezoelectric actuator in this device is 1.2 mm and the transducer length is 2.8 mm. In practice it may be desirable to vary the dimensions slightly from this ideal according to which particular higher order modes affect the motion of the material layer most strongly immediately beside the nozzle.

In order to drive such a device, rising and falling voltages are applied that reinforce the motion and thus reduce the voltage that is required to achieve a given amplitude. These voltage changes can be used to produce motion that cause one, two or many drops to be ejected. Following the ejection of the last drop that is required, the motion of the device can be stopped or significantly reduced by applying one, two or more voltage changes that are timed so as to cancel the motion of the device. This is desirable for two reasons. Firstly the frequency at which drop on demand ejection can be made from a device can be increased, as active motion cancellation can be achieved more rapidly than allowing the motion to decay to a level where it does not significantly affect the next ejection. Secondly if the motion of the device is not significantly reduced by applying a suitable signal then the ensuing motion may cause undesired drops to be ejected.

Figure 13:
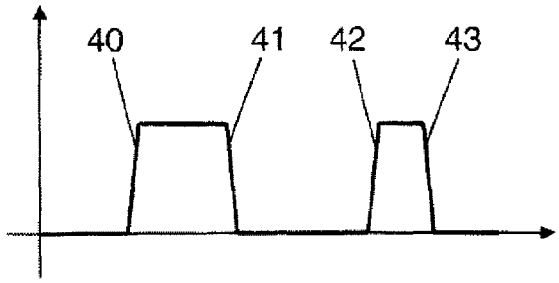
FIG. 13 illustrates drive signals applied to the actuator.

One example of such a drive scheme is shown in FIG. 13. The drive scheme consists of two pulses of equal voltage. The first voltage rise 40 and the first voltage drop 41 enhance the motion of the transducer 9 and the second voltage rise 42 and the second voltage drop 43 are designed to cancel that motion.

Because the device is mono-modal, the further voltage changes 42 and 43 can be applied to cancel the motion of the device. Such active cancellation of the motion reduces or removes motion of the material layer in substantially less time than would be the case if the motion is simply allowed to decay. This significantly reduces the delay time before a further series of voltage changes can be applied to initiate the next ejection event. With this drive scheme the drop on demand ejection frequency can be increased to up to a half of the resonant frequency of the device for ejection where the motion of the transducer is cancelled prior to initiating the motion required to eject the next droplet.

FIGS. 14*a-e* illustrate the effect of changing the timings between the four voltage changes. The material layer has a resonant frequency and associated period p and this is shown by line 400 in FIG. 14 for illustration only.

Figure 14A:
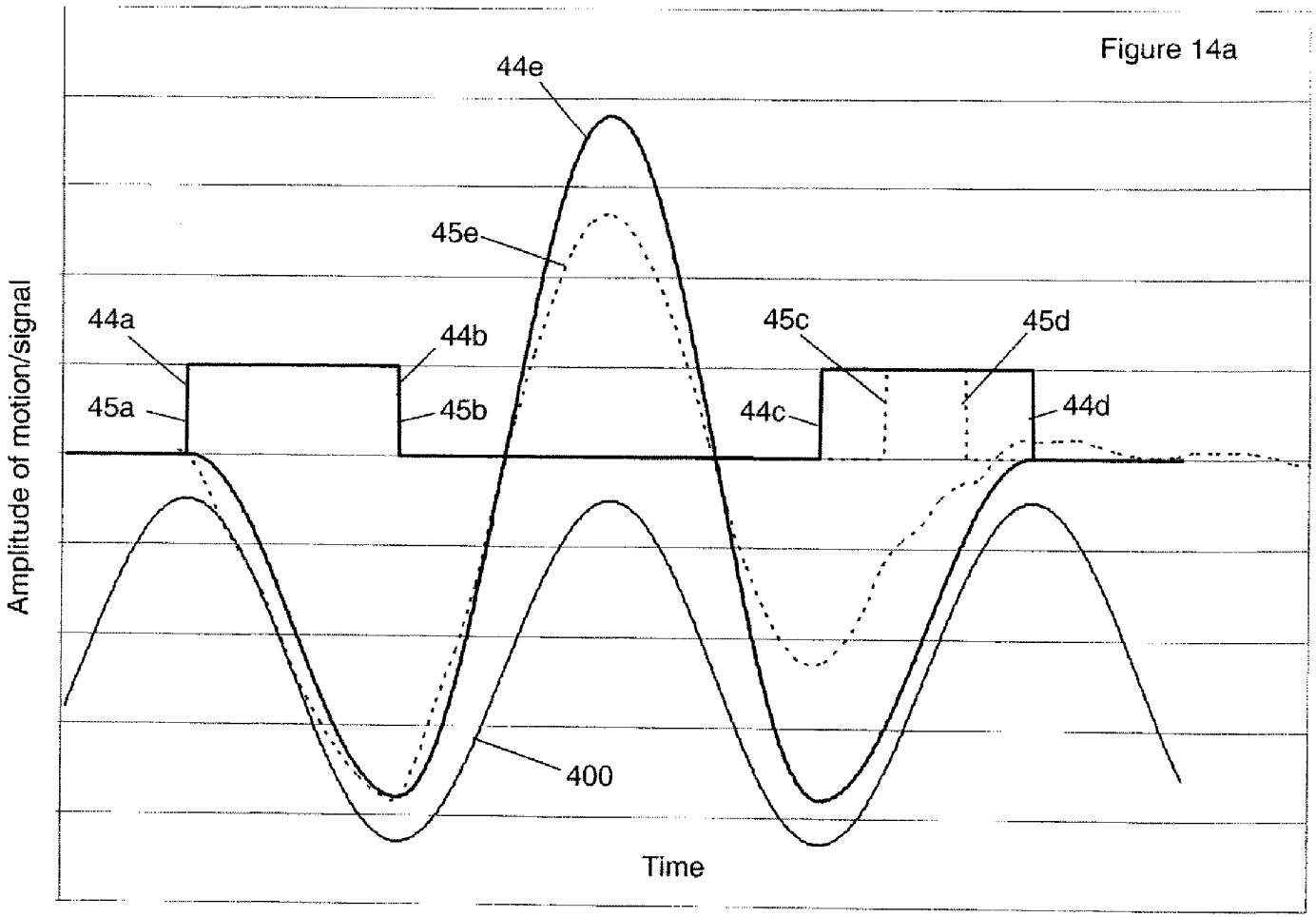
FIG. 14*a-e* illustrates the effect of different drive signals on the motion of the material layer.

In a preferred embodiment, a first falling voltage change 44*b* is timed to be a time p/2 after the first rising voltage change 44*a* so that the motion from these two voltage changes is reinforced. The motion of the material layer will be stopped if the following two conditions are met. The first condition is that the midpoint in time between the second rising voltage change 44*c* and the second falling voltage change 44*d* is 1.5 periods of the movement of the material layer after the midpoint in time between the first rising voltage change 44*a* and the first falling voltage change 44*b*. The second condition is that the second falling voltage change 44*d* is placed at a suitable time after the second rising voltage change 44*c*. In the theoretical case of a device with insignificant damping, the second falling voltage change 44*d* should be placed at a time p/2 after the second rising voltage change 44*c* in order to cancel the motion, as in the case of a device with insignificant damping, the motion of the material layer will continue with no decay of motion until the third and fourth voltage changes, This is illustrated in FIG. 14*a* by line 44*e* showing the motion of an undamped device, where the motion is cancelled when the second rising and falling voltage changes are applied.

In a device where damping is significant, the time between the second rising voltage change 44*c* and the second falling voltage change 44*d* needs to be altered in order to cancel the motion of the material layer. In particular, the gap between the second rising voltage change 44*c* and the second falling voltage change 44*d* must be increased or decreased to detune these edges to compensate for the amplitude already lost owing to the damping of the material layer.

The damping causes a reduction in amplitude with time, and whilst in order to induce the maximum motion to the material layer the first rising voltage change will occur at time t=0 and the first falling edge should still occur at t=p/2, in the same way as an undamped device, the second rising voltage change and second falling voltage change are at t>3p/2 and t<2p respectively or at t<3p/2 and t>2p respectively to compensate for the fact that the induced motion has been reduced by the damping. The case where the second rising voltage change and second falling voltage change are at t>3p/2 and t<2p respectively is illustrated in FIG. 16*a* by first rising voltage change 45*a*, first falling voltage change 45*b*, second rising voltage change 45*c* and second falling voltage change 45*d*. These voltage changes result in a response from the material layer shown in line 45*e*.

Figure 14B:
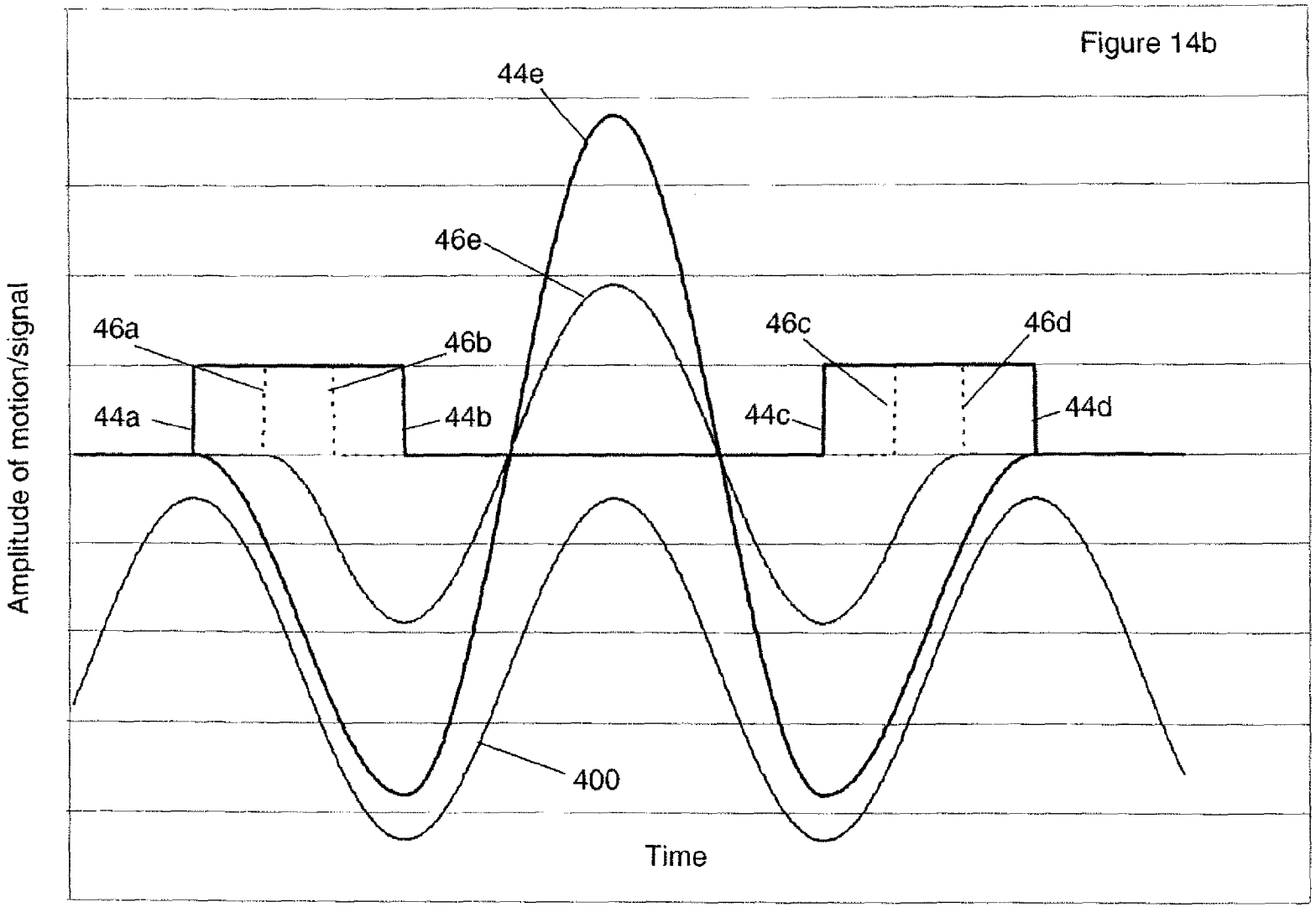

It is also possible to reduce the amplitude of motion of the material layer by increasing or decreasing the time between the first two voltage changes 40 and 41. FIG. 14*b* illustrates the affect of changing the timings of the first rising and first falling voltage changes. FIG. 14*b* illustrates a device where the damping is insignificant, i.e. a theoretical device.

In FIG. 14*b*, the theoretical motion of an undamped device is shown in line 44*e* which is produced by voltage changes 44*a*, 44*b*, 44*c* and 44*d*, as described with reference to FIG. 14*a*. When the voltage changes 44*a*, 44*b*, 44*c* and 44*d* are applied at the times shown in FIGS. 14*a* and 14*b* as described above, a maximum amplitude of motion of the material layer will be achieved. In order to reduce the motion of the material layer to say 50% of the maximum amplitude, after applying a first rising voltage change 46*a*, a first falling voltage change 46*b* is placed after the first rising voltage change at a time less than half the resonant period p of the material layer (i.e. the time between voltage changes 46*a* and 46*b* is less than the time between voltage changes 44*a* and 44*b*). As can be seen from FIG. 14*b*, this results in motion of the material layer shown in line 46*e* which has a smaller amplitude than that shown in line 44*e*. To achieve a 50% reduction in amplitude of the material layer, the first falling voltage change occurs at approximately one sixth of a resonant frequency period after the first rising edge.

The motion of the material layer represented by line 46*e* can be cancelled as described above, by applying a second rising voltage change 46*c* and a second falling voltage change 46*d*. The second rising voltage change occurs at one and a half resonant periods after the first voltage change 46*a*, and the second falling voltage change 46*d* occurs at the same time interval after the second rising voltage change 46*c* as the time period between the first rising 46*a* and falling 46*b* voltage changes.

Figure 14C:
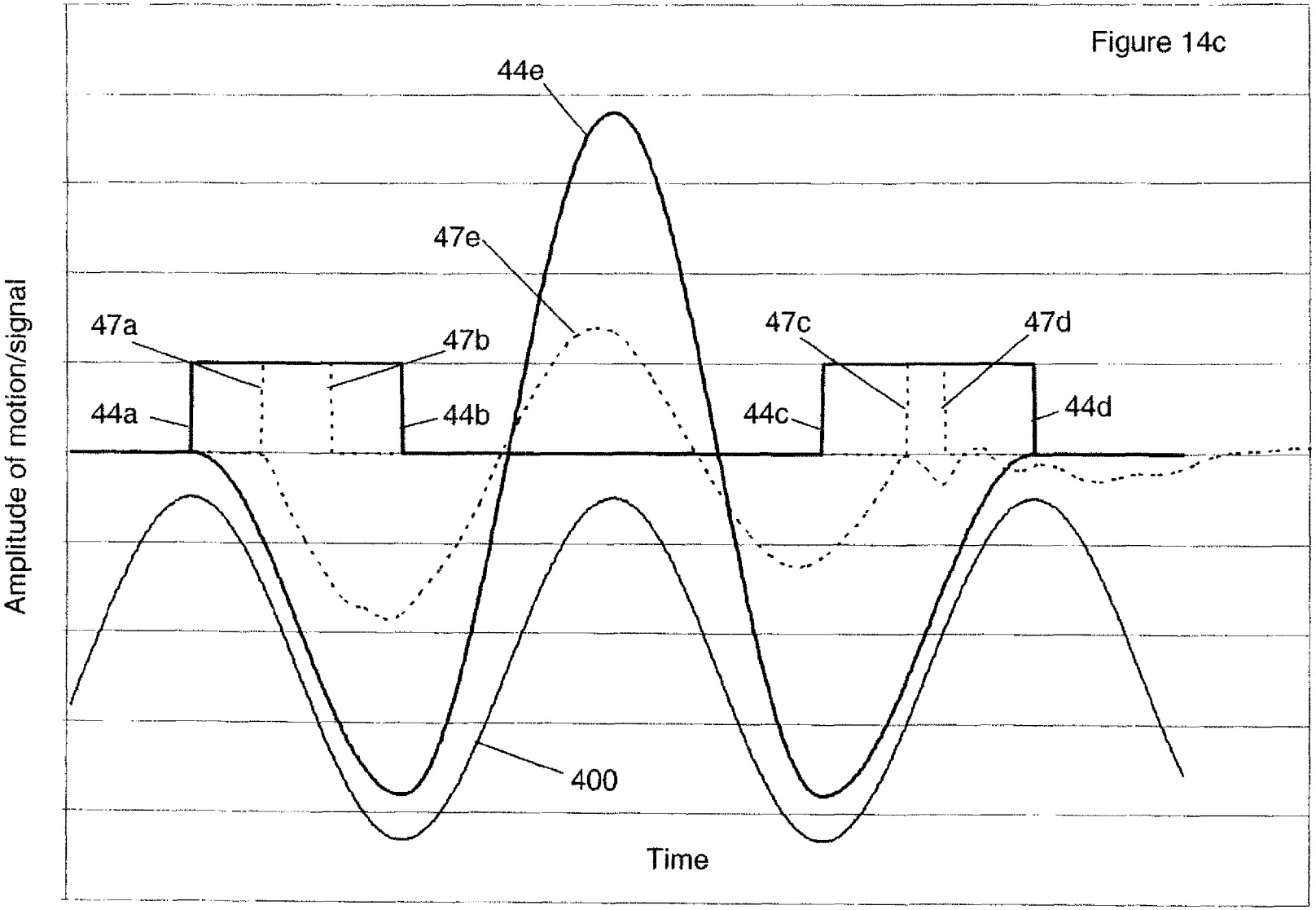

FIG. 14*a* illustrated the how the timings of the voltage changes are arranged to cancel the motion of the material layer for a damped and an undamped device. FIG. 14*b* illustrated how, for an undamped device, the amplitude of motion of the material layer can be reduced by varying the timings of the voltage changes. FIG. 14*c* illustrates a combination of FIGS. 14*a* and 14*b*.

FIG. 14*c* shows the voltage changes and response of the material layer for an undamped device at maximum amplitude. It also shows voltage changes 47*a*, 47*b*, 47*c* and 47*d* that are required to achieve reduced motion 47*e* in a damped device.

First rising voltage change 47*a* and first falling voltage change 47*b* occur at the same time as voltage changes 46*a* and 46*b*. In other words, whether the device is damped or not has no bearing on when the first rising and falling voltage changes are applied to achieve a reduction in amplitude of the material layer.

To cancel the motion shown by line 47*e*, a second rising voltage change 47*c* occurs at a time t>3p/2 and a second falling voltage change 47*d* occurs at t<2p to compensate for the fact that the induced motion has been reduced by the damping, as described in relation to FIG. 14*a*. The midpoint between the second rising edge and the second falling edge occurs one and a half periods after the midpoint between the first rising edge and the first falling edge.

Figure 14D:
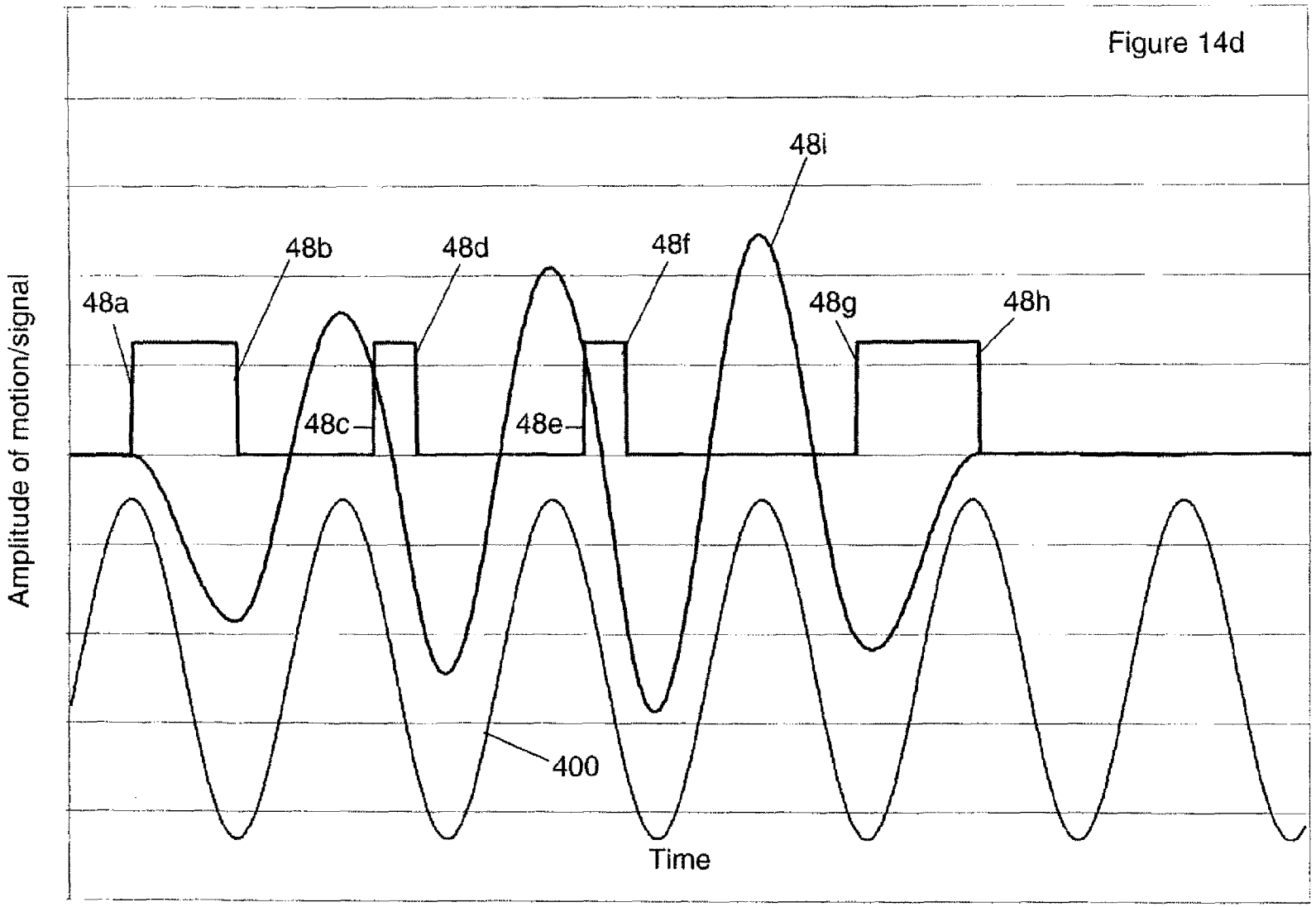
Figure 14E:
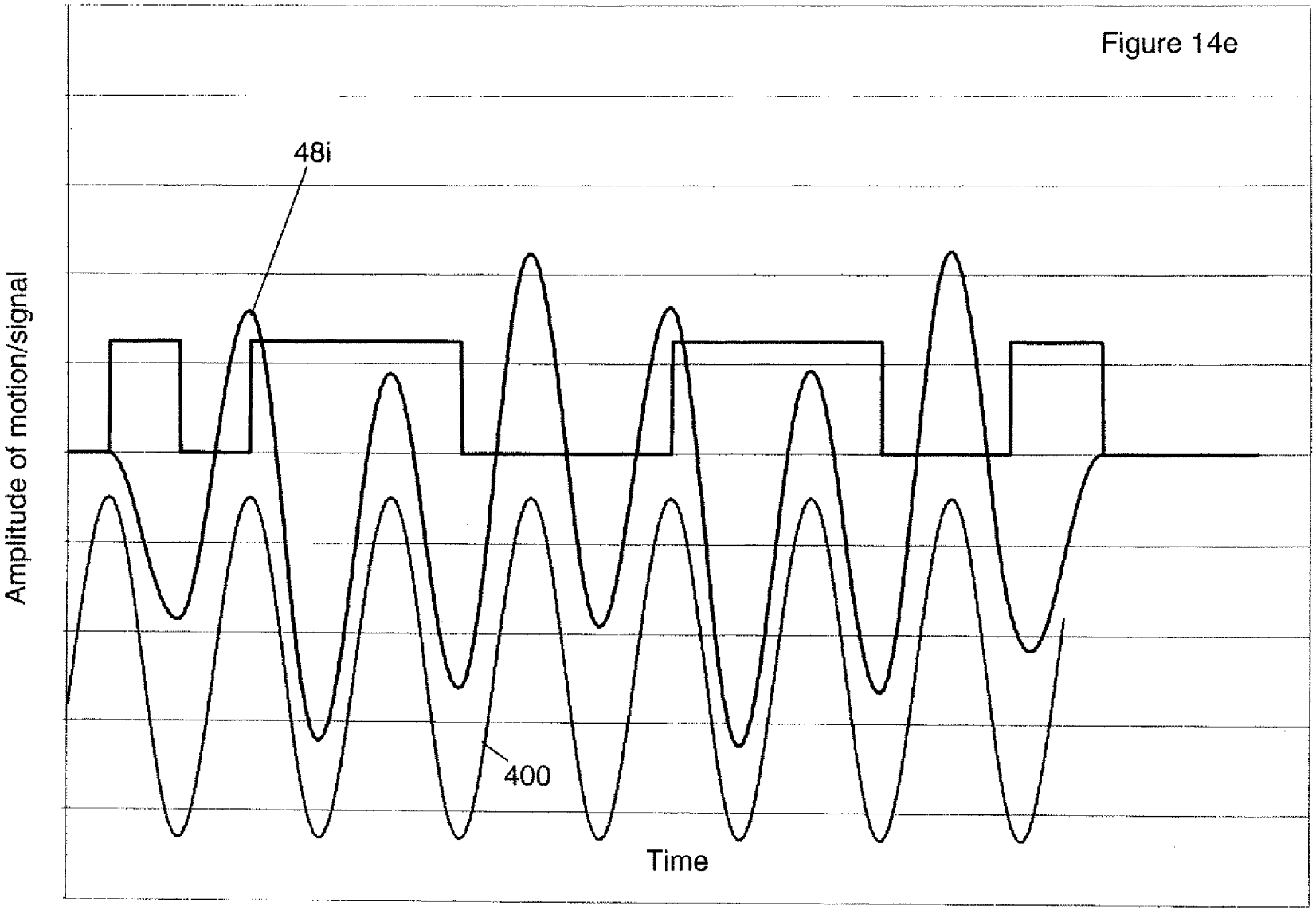

Longer sequences of reinforcing and cancelling edges can be used to eject a number of droplets at resonant frequency prior to stopping the motion. An example of such a drive scheme is shown in FIG. 14*d*. In this example six voltage changes 48*a* to 48*f* are used to generate three oscillations. The motion of the damped device to the voltage changes is shown in line 48*i*. These oscillations increase in amplitude so producing three drops of increasing velocity which will thus coalesce in flight. Then two voltage changes 48*g* and 48*h* are used to cancel the motion. In the previous examples the cancelling edges were less than p/2 apart, however the motion can also be cancelled by placing the cancelling edges more than p/2 apart. In this case 48*g* and *h* occur at <7p/2 and >8p/2. If the damping of the fingers was increased or the pulse timing was altered this drive scheme, with a correctly adjusted cancelling pulse, could be used to generate three drops with the same velocity. A second example is shown in FIG. 14*e*. In this example six voltage changes are used to eject 6 drops and then two voltage changes are used to cancel the motion. In this example more drops are produced using the same number of voltage changes as that used in the example shown in FIG. 14*d*.

The residual motion of the material layer after the cancellation pulses is a combination of any other modes of the device, the error in how accurately the decay constant is known and the error in how accurately the resonant frequency of the device is known. The amount of residual motion is less sensitive to errors in how accurately the frequency is known when the damping coefficient is larger. Thus in order to reduce this sensitivity the damping coefficient could be raised. This could be achieved in a number of ways for example: (i) bonding a lossy material to one surface of the actuator or material layer; (ii) making the material layer out of a lossy material; and (iii) placing a rigid surface close to, but not in contact with, a portion of the ink side of the material layer or actuator, there by creating a small gap which is lossy as fluid is forced in and out of the gap by the motion of the material layer.

Figure 15:
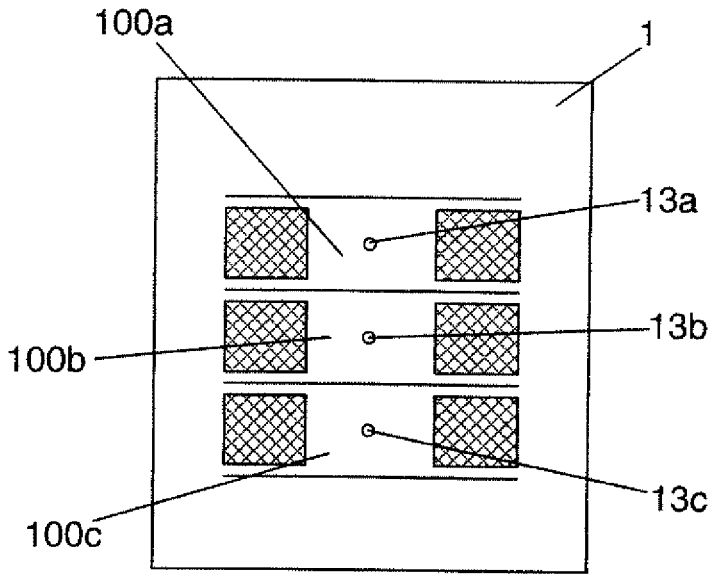
FIG. 15 illustrates a plan view of an example.

FIG. 15 shows three neighbouring independently actuated regions of material layer 100*a*, 100*b* and 100*c*. The material layer regions 100*a*, 100*b* and 100*c* are driven with different motion, to project liquid from their respective nozzles 13*a*, 13*b* and 13*c*, depending on whether adjacent nozzles are ejecting liquid at the same time. As explained above, the driving of one finger that is excited to project liquid from its associated nozzle will cause pressure fluctuations in the liquid behind its neighbouring nozzles, and therefore the ejected droplet's properties are functions of both the motion of the material layer surrounding the ejecting nozzle and that surrounding the neighbouring nozzles.

The motion with which finger 13*b* moves, if nozzle 13*b* is ejecting liquid at the same time as nozzle 13*a*, will not need to be as great as the motion required if nozzle 13*b* is ejecting alone.

The increase in pressure under a region of material layer as a result of the pressure generated under a neighbouring material layer region is shown in FIG. 9 as a function of the slot width (s) expressed as a fraction of the finger width (L).

It is desirable to ensure that the properties of the drop ejected from a nozzle 13 such as drop volume and velocity are independent of whether or not drops are ejected by neighbouring nozzles. This is achieved by adjusting the motion of the material layer surrounding the ejecting nozzle in such a way so as to compensate for the motion of the material layer surrounding neighbouring nozzles.

In order to compensate for the pressure produced by the motion of neighbouring regions of material layer, the motion of a finger is reduced when neighbouring fingers are also ejecting. This can be achieved either by changing the voltage of the drive scheme or by changing the degree to which the driving voltage changes reinforce the material layer motion. In both cases, compensation can be applied either using predetermined variations in the drive scheme, or using feedback from a sensor.

In the course of printing by ejecting ink though nozzles 13, debris, dried ink or other unwanted material (debris) can form on the material layer 100. Debris or bubbles that collect on the side of this layer which is in contact with the liquid can be removed by causing the liquid to flow across the material layer 100 using an internal or external means. In order to remove debris from within the nozzles and on the side of the material layer 100 that is not normally in contact with the liquid, it is necessary to periodically clean this surface of the material layer 100.

Figure 16:
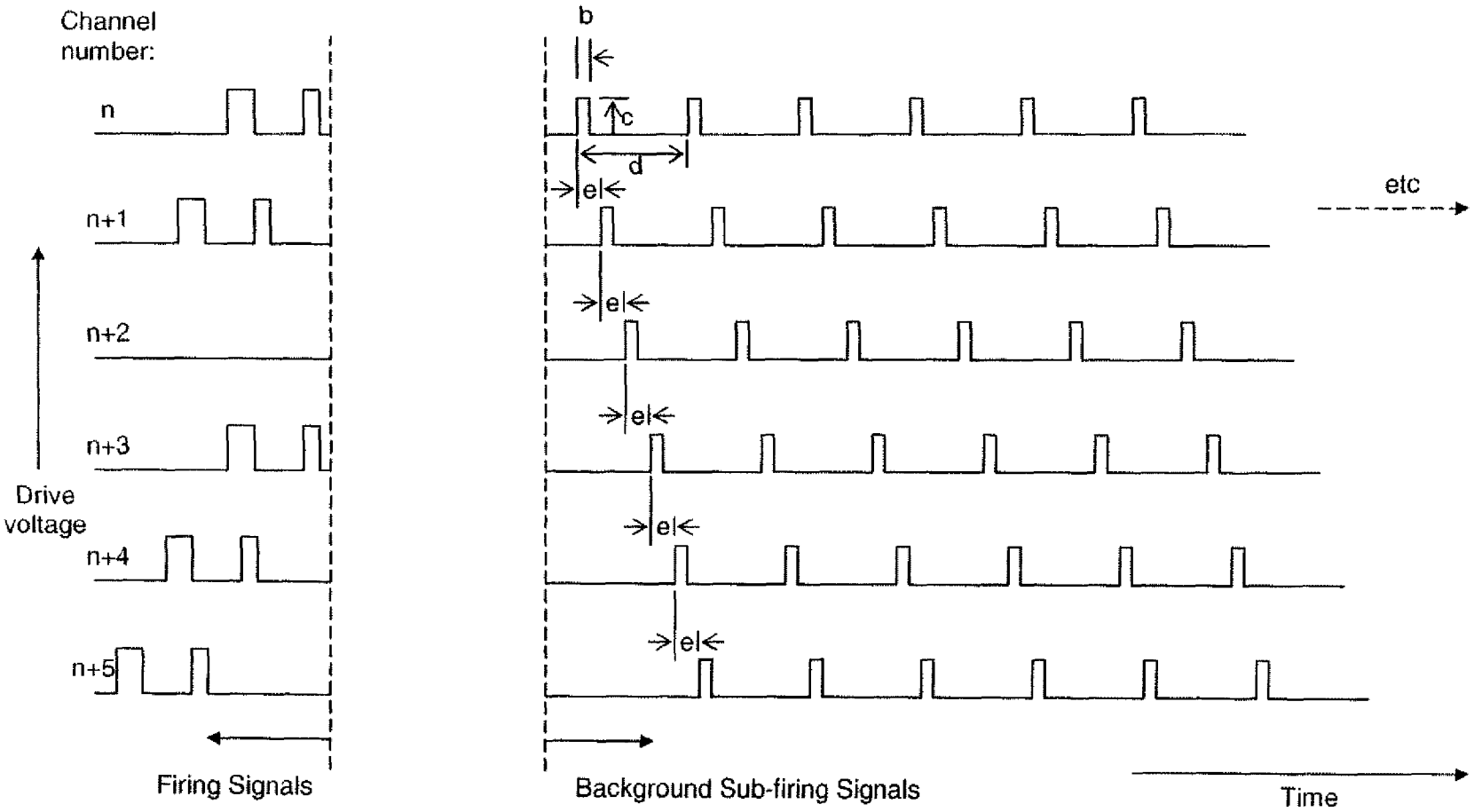
FIG. 16 shows one example of a firing/sub-firing regime for an injecting head comprising six nozzles.
Figure 17B:
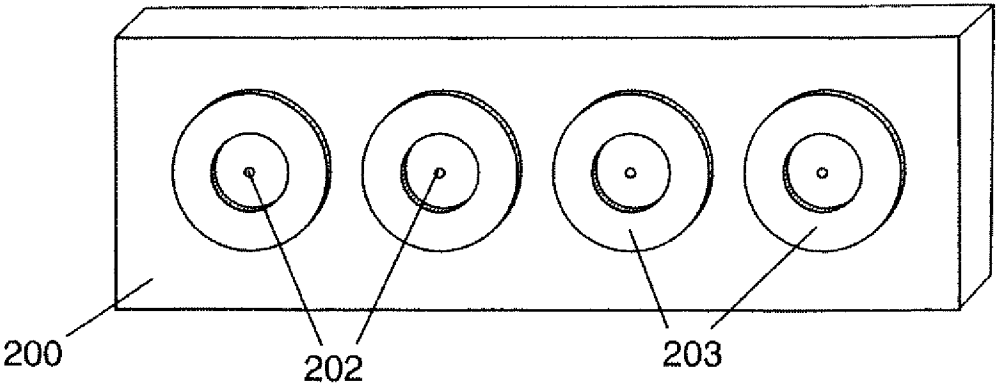
FIGS. 17*a* to 17*c* shows a specific droplet generator having four nozzles which can be driven in the manner similar to that of FIG. 16.
Figure 17A:
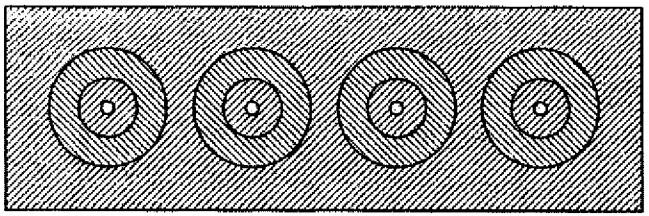
Figure 17C:
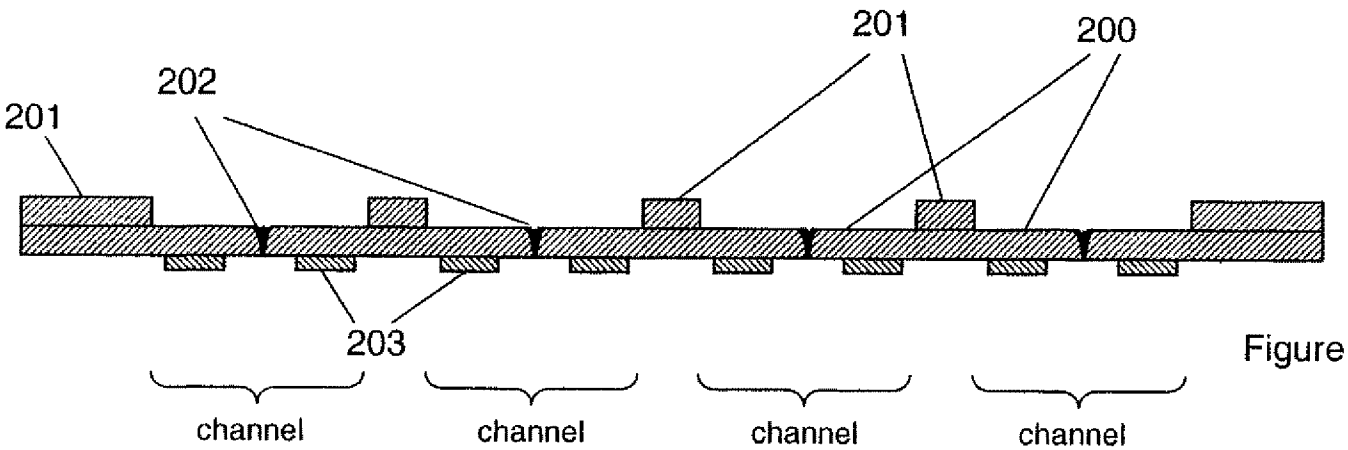

FIG. 16 shows one example of a firing/sub-firing regime for ejecting head comprising 6 nozzles which are driven both with firing signals (shown to the left of the dotted line), and by sub-firing signals (shown to the right of the dotted line). In particular, the nozzles are driven using firing signals similar to those described above, such that the drive signal takes the form of two pulses, each having a rising voltage change and a falling voltage change. In the example shown, channel n+2 has no firing signal, whereas the other 5 channels have firing signals at differing stages, although channel n and channel n+3 are driven at the same time.

The invention is applicable to a single group of nozzles, as shown in FIG. 16, but alternatively multiple groups may be used. Those groups may be arranged such that group 1 is channels 1-3, group 2 is channels 4-6 etc. Alternatively group 1 could consist of channels 1, 4, 7, group 2 channels 2, 5, 8 etc. The groups may be formed in any suitable manner such that motion of the bulk fluid in the open chamber is achieved.

In a multiple group scenario, the nozzles are preferably split into specific groups, each group having one or more nozzles, where in each group has its sub-firing signal at the same time. Thus, there could be a situation in which channel n and channel n+1 form a group, channel n+2 and n+3 form a group etc. These groups may have the same number of channels or, alternatively, may have differing numbers of nozzles, i.e. group 1 contains 3 channels, group 2 contains 4 channels, group 3 contain 3 channels etc. The number of channels in a group does not necessarily follow any pattern, but in practice the number of channels per group will not vary by more than one or two.

The sub-firing signals may also constitute multiple signals in the same way as the firing signals. In any case, the sub-firing signals, shown to the right of the vertical dotted line are a series of pulses, in this example of lower duration and lower amplitude, although the signals only need to be modified such that ejection does not occur. By this, we mean that the sub-firing signals simply cause no ejection, and this may be achieved by altering any one of the parameters of the signal, such as duration or amplitude.

In the example shown in FIG. 16, the initial sub-firing signal on channel n occurs at a time independent of the previous ejection event and in practice it is likely that the initial sub-firing signal will begin prior to the onset of firing signals. It is possible that the time may be zero, i.e. the sub-firing signal may start immediately after the end of a firing signal, or even that there will be a short delay in order that the motion of the nozzle caused by the firing signal can fully decay such that the nozzle is stationary when the sub-firing signal is given. In any event, the start of the sub-firing signal on channel n causes the sub-firing signal on channel n+1 to start at a pre-determined phase relationship with respect to the sub-firing signal on channel n. This is represented by time e.

In the example shown in FIG. 16, the time e is constant between adjacent channels, such that there is a regular phase shift between adjacent channels. This is preferable, although it is envisaged that time e does not necessarily need to be the same between each group of nozzles.

The sub-firing signals in this example have a pulse duration of b and a pulse amplitude of c. There is a time delay of d between sub-firing signals on a single channel.

In the example shown, channel n and channel n+5 are 360° out of phase, such that the first sub-firing signal on channel n+5 occurs at the same time as the second sub-firing signal on channel n.

Particular advantages may be achieved by taking advantage of the resonance of any ejecting head in which these nozzles are located. In order to do this, the time period d between consecutive sub-firing pulses for each channel should be zT, where z is an integer and T is the time period of the resonance of the device. For example, for 50 kHz device, T is 20 microseconds and if is z is chosen to be 2, then d would be 40 microseconds.

In order to set up acoustic streaming in the device, e could range from 0.1 T to 10 T, although it is possible that acoustic streaming could occur outside of this range. This range is merely preferable.

A further example of a droplet generator is shown in FIG. 19 in which a series of four circular actuators are provided, although a greater or lesser number could be used. These actuators could be of the type described in WO93/10910. In particular, a nozzle plate 200 is provided mounted on a chassis 201. The nozzle plate 200 has a plurality of nozzles 202 extending there through, in the example shown the nozzles have a reverse taper, i.e. they are wider on the outlet side (the upper surface) than the inner face (i.e. the lower face), although other nozzles shapes or forms could be used. Circular piezoelectric elements 203 are provided around each nozzle 202 and are controllable independently via a control means to produce the firing and sub-firing signals as described above.

In any of the examples, it may be possible to use an oscillatory drive signal, oscillating at (approximately) the mechanical resonant frequency of the nozzle, to create a 'burst' of droplets. A non-firing signal could be generated that is specifically de-tuned from the resonant frequency, for example 10 kHz slower. For example, the drive signal could be a rectangular signal at 30V at 80 kHz. The sub-firing signal could be the same or less voltage, but at (say) 70 kHz.

Each of the examples described above could usefully confer benefit in all application fields including, but not restricted to: an inkjet printer/dispenser, an office printer/dispenser, to image a printing plate to function as an offset master, to print onto packaging, to directly mark food stuffs, to mark paper for example to generate receipts and coupons, to mark labels and decals, to mark glass, to mark ceramics, to mark metals and alloys, to mark plastics, to mark textiles, to mark or deposit material onto integrated circuits, to mark or deposit material onto printed circuit boards, to deposit pharmaceuticals or biologically active material either directly onto human or animal or onto a substrate, to deposit functional material to form part of an electric circuit, for example to alter or generate an RFID tag, an aerial or a display.

In most printer/dispensers (by dispensers we mean any type of fluid dispenser), the "clock" which sets a timing of both firing and sub-firing signals is normally derived from a mechanical system associated with the printed substrate movement (such as an encoder) due to potential inaccuracies in the substrate positioning. It is, however, possible for the printhead/dispenser to receive firing or sub-firing signals independently from a substrate control system, but this requires that the substrate end printhead/dispenser movement be highly accurate to ensure accurate placement of printed dots (pixels) on the substrate. If the appropriate level of accuracy can be achieved, it is possible for the sub-firing signals to be derived from a clock signal sent to the printhead/dispenser and the firing signals to be derived from the mechanical substrate system.

When we talk about firing and sub-firing signals, both signals can benefit from being a combination of multiple signals. For example, the first part of the signal may be used to enable fluid ejection from a nozzle and the second part of the signal may be used to reduce movement of the transducer so that the transducer is ready to fire (or sub-fire) quickly. An example of a two pulse firing signal is shown in FIGS. 14*a-e*, so that the printhead/dispenser is ready to fire at any particular instant of time.

The present invention acts to efficiently re-disburse the concentrated build up of ink components at the nozzle which enables improvement in reliable performance and allows consistency in the material being printed at any particular firing event.

In a practical situation, a printer/dispenser incorporating the present invention has to be made ready for printing, for example, when first turned on or prior to a print run, and after printing or dispensing is finished, the sub-firing signals would need to continue for either a defined period, or indefinitely, and when finished, the printhead/dispenser could then optionally go through a maintenance routine and be capped. As such, the invention covers the situation in which the sub-firing signals are turned on at the same time as or shortly after the printer/dispenser or dispenser is turned on and those sub-firing signals continue until the print or dispensing head has stopped printing/dispensing all together. Where the printer/dispenser or dispenser is on but has been inactive for a period of time, the sub-firing signals may be restarted before or at the same time as the printer/dispenser or dispenser receives a new firing signal. In both situations described above, the start of the sub-firing signals is still independent of any ejection event. The firing signals, which may be a combination of pulses as explained earlier in this section are then "random" events in a continuum of sub-firing signals in the printhead/dispenser. Those sub-firing signals provide continuous acoustic streaming and are independent of the timing of firing signals.

Thus, the sub-firing signals in each group of N nozzles which start prior to printing or dispensing, typically from the moment the printer/dispenser or dispenser is turned on and made ready, such as the completion of a maintenance routine or the removal of a printhead/dispenser cap. The clocking of these "preprint" sub-firing signals would be derived from an electronic clock signal sent to the printhead/dispenser and would have a non-zero phase relationship to effect the acoustic streaming and re-disburse local concentrations of material in the ink.

On a command to start printing, the clock on which the sub-firing signals are derived would then be typically driven from the mechanical substrate clock. It is worth noting that the clock from a mechanical system may not clock out perfect timing due to the inaccuracies in the mechanical system. Therefore the timing of sub-firing signals may not be ideal to achieve perfect acoustic streaming, but it is still highly beneficial to have a non-zero phase relationship to provide movement of the re-disbursed materials away from each nozzle into the bulk fluid.

The sub-firing signals continue to fire in their non-zero phase relationship and independently of firing signals. The image data to be printed is interrogated and, where there is a pixel to be printed (or drop ejection event to occur) the firing signals takes precedence and replaces the sub-firing signal. In this way, the timing of a firing signal is effectively a random event in the otherwise continuous sub-firing signal. The sub-firing signals are only dependent on the clock and not the firing signals. The sub-firing signals would therefore not coincide with the timing of the firing signal and they are not in any way synchronised with the firing signals. A further benefit of this is that the start of printing is always consistent and there is no delay in the start up of said firing signals after a print event or after the printer/dispenser has been made ready for printing.

In a further embodiment, in which the sequence of time events is provided by the substrate system, a sub-firing signal would be triggered by the firing signal on a different, perhaps adjacent, channel and the acoustic streaming could be initiated from that event. In this case, there is again no synchronisation between sub-firing and firing signals on the same nozzle or group of nozzles.

The invention claimed is:

1. A method of producing droplets from a nozzle provided on a material layer, the method comprising the steps of:

supplying liquid to an inner end of an array of nozzles, the nozzles being split into M groups of one or more nozzles;

generating one or more firing signals, each firing signal causing sufficient movement of a group of nozzles relative to the liquid such that liquid is projected as droplets from the outer face of the respective nozzles; and generating one or more sub-firing signals associated with each group of nozzles, the one or more sub-firing signals causing movement of the group of nozzles which is insufficient to project liquid from the nozzles, the sub-firing signals of adjacent groups having a non-zero phase relationship, wherein the sub-firing signal(s) of at least one group of nozzles is independent of the firing signal(s) associated with that group.

2. A method according to claim 1, wherein M is an integer greater than zero.

3. A method according to claim 1 or claim 2, wherein the amplitude of the sub firing signal(s) is shorter than that of the firing signal(s).

4. A method according to claim 1 or claim 2, wherein the duration of the sub firing signal(s) is lower than that of the firing signal(s).

5. A method according to claim 1, wherein the frequency of the sub firing signal(s) is different to that of the firing signal (s).

6. A method according to claim 1, wherein the sub-firing signal(s) associated with a group of nozzles produces motion in the nozzles in that group.

7. A method according to claim 1, wherein the phase difference between adjacent groups is $2\pi(yM+1)/M$, where y is a non-negative integer.

8. A method according to claim 1, wherein the sub-firing and/or firing signals are single pulses.

9. A method according to claim 1, wherein the sub-firing and/or firing signals include multiple pulses.

10. A method according to claim 1, wherein the number of nozzles in each group is the same.

11. A method according to claim 1, wherein the number of nozzles varies between groups.

12. A method according to claim 1, wherein the sub-firing signals are driven by a separate clock to the firing signals.

13. A method according to claim 1, wherein sub-firing signals occur on a particular nozzle or group of nozzles prior to the first firing signal on that nozzle or groups of nozzles.

14. A method according to claim 1, wherein the sub-firing signal on a particular nozzle or group of nozzles is dependent upon the firing signal from a different nozzle or group of nozzles.

15. A method according to claim 1, wherein the firing signals include both firing and stopping pulses.

16. An apparatus for producing droplets, the apparatus comprising:

an array of nozzles, the nozzles being split into M groups of one or more nozzles;

means for supplying liquid to an inner end of the array of nozzles;

control means for generating one or more firing signals, each firing signal causing sufficient movement of a group of nozzles relative to the liquid such that liquid is projected as droplets from the outer face of the respective nozzles; and control means for generating one or more sub-firing signals associated with each group of nozzles, the one or more sub-firing signals causing movement of the group of nozzles which is insufficient to project liquid from the nozzles, the sub-firing signals of adjacent groups having a non-zero phase relationship, wherein the sub-firing signal(s) of at least one group of nozzles is independent of the firing signal(s) associated with that group.

* * * * *